US005588471A

United States Patent [19]

Lowe

[11] Patent Number: 5,588,471

[45] Date of Patent: Dec. 31, 1996

[54] CONTAINER FILLING APPARATUS

[76] Inventor: Terry B. Lowe, 133 Pagosa Way, Fremont, Calif. 94539

[21] Appl. No.: 401,462

[22] Filed: Mar. 9, 1995

Related U.S. Application Data

[60] Continuation of Ser. No. 584,202, Sep. 18, 1990, abandoned, which is a division of Ser. No. 103,519, Oct. 1, 1987, Pat. No. 4,957,147.

[51] Int. Cl.[6] ..... B65B 3/28

[52] U.S. Cl. ..... 141/83; 141/87; 141/95; 141/198; 141/88; 141/250; 141/263; 141/47; 141/311 A; 222/108; 222/494; 137/393

[58] Field of Search ..... 141/83, 94–96, 141/192, 198, 86–88, 255, 263, 279, 284, 47, 311 A, 374, 258, 259, 260, 264; 137/393, 312, 313; 222/108, 491, 494, 510, 519, 515, 556

[56] References Cited

U.S. PATENT DOCUMENTS

| | | | |
|---|---|---|---|
| 1,965,290 | 7/1934 | Klindinst | 222/491 |
| 2,208,028 | 7/1940 | Harrington | 141/263 |
| 2,938,551 | 5/1960 | Hallstan | 141/284 X |
| 3,005,473 | 10/1961 | Ring | 141/264 |
| 3,087,517 | 4/1963 | Magnuson et al. | 141/88 X |
| 3,559,702 | 2/1971 | Riesenberg | 141/374 X |
| 3,613,747 | 10/1971 | Trusselle | 141/198 |
| 3,779,292 | 12/1973 | Mencacci | 141/374 X |
| 3,893,493 | 7/1975 | Forrest et al. | 141/47 |
| 3,920,056 | 11/1975 | Piecuch | 141/94 |
| 4,317,475 | 3/1982 | Miller et al. | 141/95 |
| 4,377,802 | 7/1982 | Kennedy et al. | 141/83 |
| 4,493,750 | 1/1985 | Beikel et al. | 141/192 X |
| 4,494,583 | 1/1985 | Reeves, Jr. et al. | 141/83 |
| 4,522,228 | 6/1985 | Campau | 137/393 |
| 4,709,836 | 12/1987 | Anderson | 222/494 |
| 4,915,147 | 4/1990 | Skibowski | 141/181 |

FOREIGN PATENT DOCUMENTS

| | | | |
|---|---|---|---|
| 550 | 6/1899 | Austria | 141/284 |
| 1301 | 1/1900 | United Kingdom | 141/88 |

*Primary Examiner*—Henry J. Recla
*Assistant Examiner*—Steven O. Douglas
*Attorney, Agent, or Firm*—Flehr, Hohbach, Test, Albritton & Herbert

[57] ABSTRACT

Apparatus for filling drums and other containers with a lilquid product. The apparatus can be used for both subsurface and top filling operations. The level of the liquid in the container is monitored to prevent overfilling and withdrawal of the lance at an incorrect speed during a subsurface filling operation. A self closing cap is provided at the lower end of the lance, and a drip catcher is automatically moved into position beneath the lance when it is withdrawn from the container.

3 Claims, 8 Drawing Sheets

TO LANCES 122
146
147
148
149
151
152
153
154
SNAP RELAY
156
157
158
159
FLUID AMP
161
162
163
164
SHUTTLE VALVE
166
167
168
PRESSURE RESPONSIVE SWITCH
169
RESET VALVE
171
172
90 PSI
10 PSI
5 PSI

CONTAINER FILLING APPARATUS

CROSS-REFERENCE TO RELATED APPLICATION

This is a continuation of Ser. No. 07/584,202, filed Sep. 18, 1990, now abandoned which was a division of Ser. No. 07/103,519, filed Oct. 1, 1987, now U.S. Pat. No. 4,957,147.

BACKGROUND OF THE INVENTION

1. Field of the Invention

This invention pertains to apparatus for filling drums and other containers with a liquid.

2. Description of the Related Art

Drums and other containers are commonly filled by machines having lances which may extend into the containers for delivering the liquid into the containers. Depending upon the nature of the liquid, the distal end or tip of the lance may be positioned either above or below the surface of the liquid during a filling operation. With liquids which tend to foam or produce fumes or noxious odors, the liquid is generally introduced at a relatively slow or "dribble" rate initially with the tip of the lance near the bottom of the container. Once the level of the liquid has risen above the tip of the lance, the flow rate can be increased, and the tip of the lance is maintained below the surface of the liquid for the remainder of the filling operation. This type of filling operation is known as subsurface filling. With other liquids, disturbance of the liquid during a filling operation is not a problem, and the lance can remain in the upper portion of the container. This type of filling operation is known as top filling. With either type of filling operation, the filling rate is generally decreased as the level of the liquid approaches the top of the container to prevent over filling and spillage of the liquid.

The amount of liquid which is delivered to a container and the rate at which it is introduced can be controlled either manually or automatically. A manually controlled system has the advantage of being somewhat simpler and less expensive to install, but it requires more time and attention on the part of the operator. An automated system is generally more expensive initially, but it is generally more economical to operate.

One example of an automated system for subsurface filling operations is described in U.S. Pat. No. 4,337,802.

It is in general an object of the invention to provide new and improved apparatus for filling drums and other containers with a liquid product.

Another object of the invention is to provide apparatus of the above character which overcomes at least some of the limitations and disadvantages of drum fillers heretofore provided.

Another object of the invention is to provide apparatus of the above character which is economical to manufacture and easy to operate.

SUMMARY OF THE INVENTION

These and other objects are achieved in accordance with the invention by providing drum filling apparatus having a base, an arm mounted on the base for movement between raised and lowered positions, and a filling lance carried by the arm for introducing a liquid into a container. Embodiments are enclosed for use in both subsurface filling operations and top filling operations. In both types of operations, the level of the liquid is monitored to prevent overfilling of the container, and in the subsurface system, the rate at which the lance is withdrawn is determined by the level of the liquid. A drip catcher is automatically positioned beneath the lance as it is withdrawn, and a self-closing cap is provided at the lower end of the lance. In one embodiment, the arm which carries the lance is pivotally mounted on the base, and in another embodiment the arm is mounted on and supported by an operating cylinder which serves as an extendable post. The flow control valves and the operating cylinders are pneumatically operated, and plastic lines are utilized in the pneumatic system.

DETAILED DESCRIPTION

Figure 1:
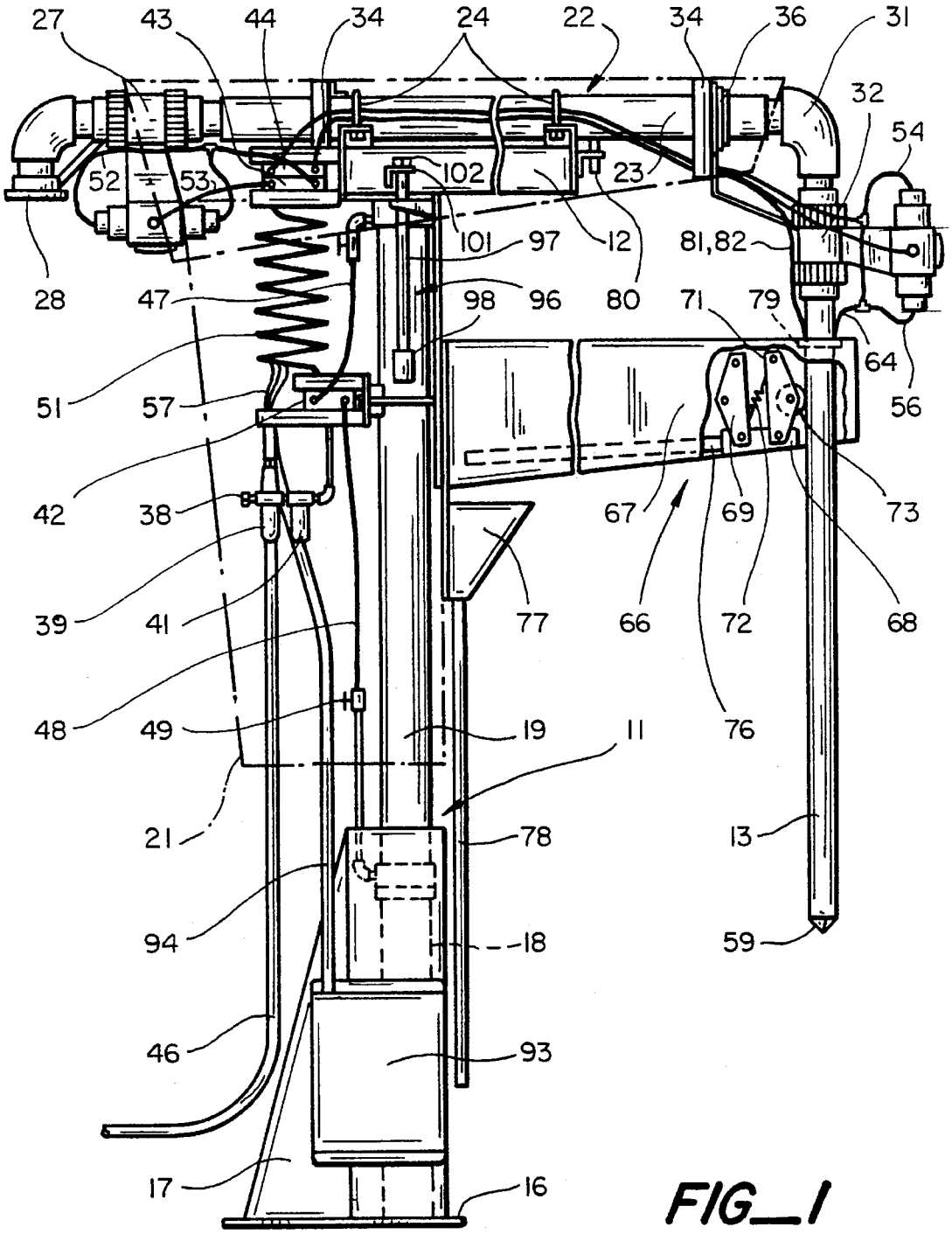
FIG. 1 is a side elevational view, partly broken away, of one embodiment of container filling apparatus according to the invention.
Figure 2:
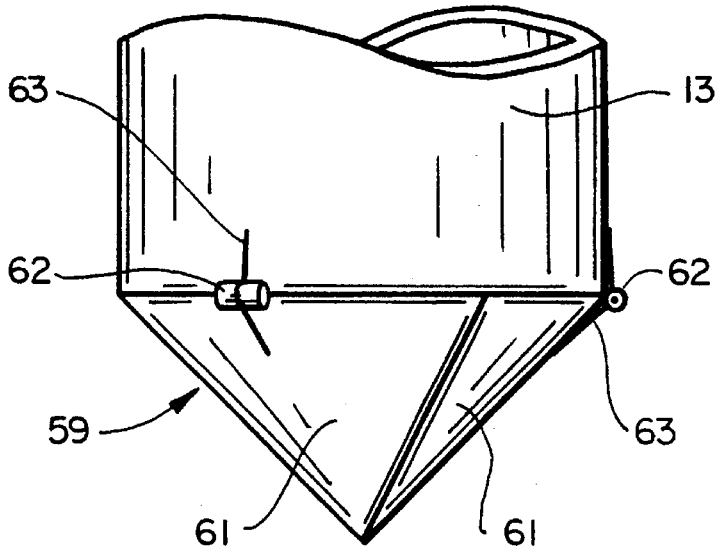
FIG. 2 is an enlarged fragmentary side elevational view of the lower portion of the filling lance in the embodiment of FIG. 1.
Figure 3:
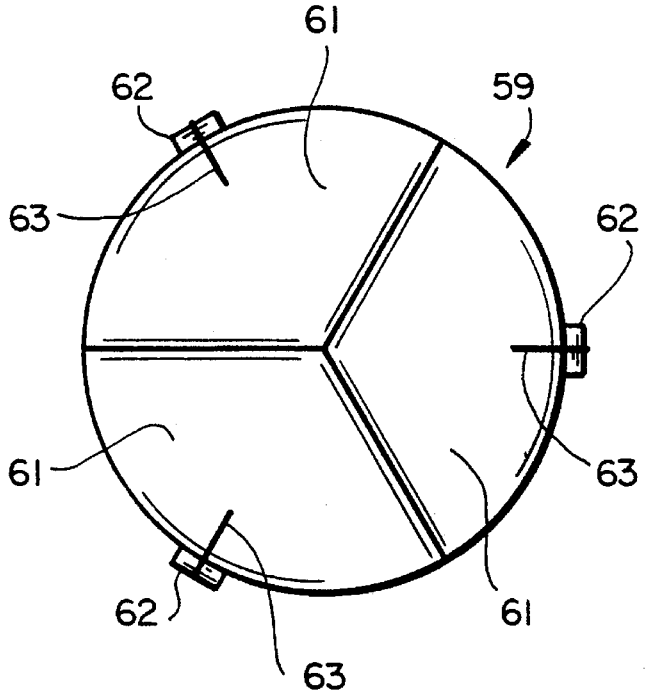
FIG. 3 is a bottom plan view of the lower portion of the filling lance in the embodiment of FIG. 1.
Figure 4:
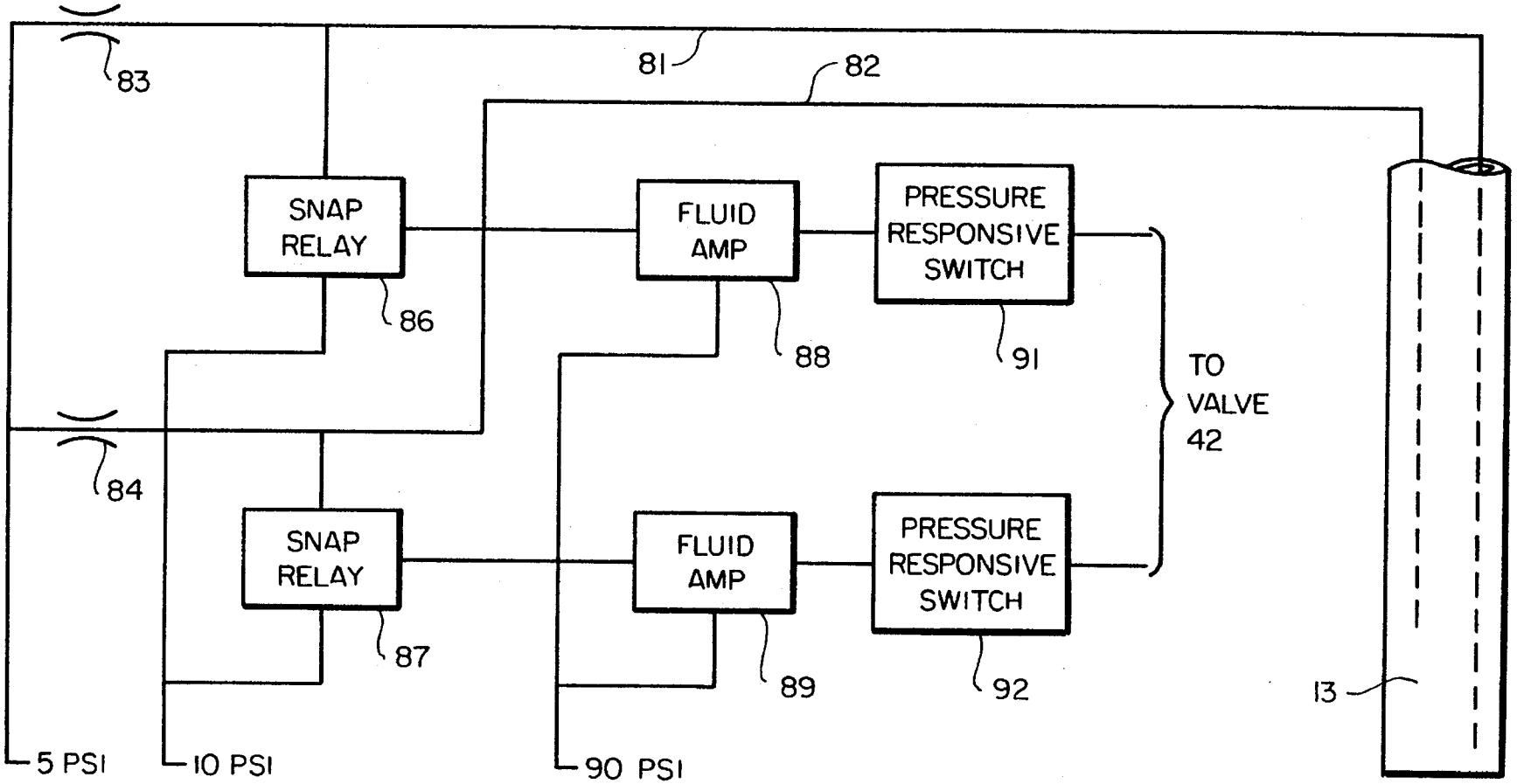
FIG. 4 is a block diagram of a system for controlling the assent of the lance and preventing overfilling of a container in the embodiment of FIG. 1.

As illustrated in FIG. 1, the container filling apparatus has a base 11 on which a horizontally extending arm 12 is mounted, with a vertically extending lance 13 for introducing a liquid product into a container (not shown). As discussed more fully hereinafter, the arm is movable between raised and lowered positions so that the lance can be extended and retracted relative to the container.

Base 11 has a plate 16 which can be bolted to the floor or other supporting surface, with lower side plates 17 and a short upstanding post 18. The post has a pair of telescopically extensible sections by which the length of the post and, hence, the height of arm 12 can be adjusted. A pneumatic operating cylinder 19 is mounted on the upper end of post 18 and extends in an upright position to form an extensible support column. In the embodiment illustrated, a flange at the lower end of the cylinder body is bolted to a flange at the top of the post, and arm 12 is affixed to the operating rod or piston of the cylinder. The operating cylinder is selected to have a stroke corresponding to the maximum distance the filling lance must travel between its extended and retracted positions. The cylinder is shown in its fully retracted position in FIG. 1.

A front cover 21 is mounted on the base in a stationary position above lower side plates 17 and secured to mounting brackets (not shown) affixed to the body of cylinder 19.

A manifold 22 which carries the liquid to be introduced into the container is mounted on horizontal arm 12. The manifold comprises a horizontally extending tubular section 23 which is secured to arm 12 by U-bolts 24. A pneumatically operated fill rate control valve 27 is connected to the inlet end of the maniford, with connector 28 such as a quick disconnect fitting or a flange for connection to a hose or other conduit which carries the liquid product. Valve 27 can be set to provide either a normal or fast fill rate or a dribble or slow fill rate.

Lance 13 is connected to the outlet end of tubular section 23 by an elbow 31 and a pneumatically operated ball valve and actuator 322. The manifold and the lance thus form a unitary structure and are raised and lowered together as cylinder 19 is extended and retracted. The ball valve serves as a flow control or ON/OFF valve for the liquid product.

A U-shaped top cover 33 covers the manifold and arm assembly and is secured to mounting plates 34 carried by the tubular section 23 of the manifold. A boot 36 provides a seal between the front mounting plate and the tubular section.

Air at a suitable pressure (e.g. 90 psi) for operating cylinder 19 and valves 27, 32 is applied to an inlet fitting 38. The incoming air passes through a filter/regulator 39 and a lubricator 41. The air is applied to valves 42 and 43, 44 which control the operation of cylinder 19 and valves 27, 32, respectively. Valve 42 is mounted on the stationary body of the cylinder, and valves 43, 44 are mounted on arm 12. Signals for controlling the operation of valves 42–44 are provided by air lines bundled into a cable 46 from a control panel (not shown).

Valve 42 is connected to the upper and lower ends of cylinder 19 by lines 47, 48, respectively, with needle/flow control valves 49 for adjusting the rate at which the cylinder is extended and retracted. Air is supplied to valves 43, 44 by a coiled line 51 which can extend and retract as the manifold and arm assembly is raised and lowered. The air from valve 43 is applied to the actuator for valve 27 by lines 52, 53, and air from valve 44 is applied to the actuator for valve 32 by lines 54, 56. The air lines and the fittings associated therewith are all fabricated of a suitable plastic material such as polyethylene, polypropylene or Teflon. The plastic lines are light in weight and relatively inexpensive, and they have been found to perform surprisingly well in the pneumatic system of the filling apparatus.

The air lines which carry the signals from cable 46 to valves 43, 44 are coiled within line 51 for extension and retraction as the arm and manifold assembly is raised and lowered.

A hinged cap 59 is provided at the lower end of lance 13. This cap has a plurality of conically curved sections 61, each of which is pivotally connected to the lower end of the lance by a hinge 62. In the embodiment illustrated, the cap has three sections, but it can have any other suitable number desired (e.g., two, four, or more). Torsion springs 63 urge the sections of the cap toward the closed position in which the cap has a generally conical contour. The springs permit the cap to be opened by the liquid product which passes through the lance when valve 32 is open. In the closed position, cap sections 61 close off the lower end of the lance. In the open position, they swing back out of alignment with the passageway within the lance so that they do not impede the flow of liquid through the lance.

A vent line 64 and check valve vent the upper portion of the lance to the atmosphere to permit the liquid to drain from the lance when valve 32 is closed.

A drip catcher 66 is provided for catching any liquid which may drip from the lance when the lance is in its raised position. The drip catcher includes a stationary support arm 67 which extends horizontally from the upper portion of base 11. A drip cup 68 is mounted on the support arm by parallel pivot arms 69, 71 for movement between extended and retracted positions relative to the lance. The drip cup is urged toward the extended position in alignment with the lance by a spring 72 connected between the lower end of pivot arm 69 and the upper end of pivot arm 71. A roller or slide plate 73 carried by pivot arm 71 engages the side of the lance when the lance is in its extended or lowered position. When the lance is raised and the tip of the lance clears the roller, the drip cup swings to its extended position beneath the lance. As the lance descends, end cap 59 engages the roller, and the drip cup is deflected back to its retracted position.

A downwardly sloping drain trough 76 extends to the rear of drip cup 68, and a drip collector 77 with a drain line 78 is mounted on the base beneath the rear end of the trough. Collector 77 is wide enough to remain beneath the end of the trough regardless of the position of the drip cup.

A wiper 79 is carried by the drip catcher assembly for wiping the liquid product from the exterior wall of the lance as the lance is raised. The wiper comprises an annular member mounted in a stationary position on arm 67 and encircling the lance. The liquid wiped from the lance drops into the container or the drip cup depending upon the position of the lance at the time.

A sensor 80 is mounted on arm 12 for interrupting the descent of the lance in the event that it should strike something on the way down, as might for example happen if the lance is not properly aligned with the fill hole in a drum. U-bolts 24 permit the manifold and lance to rise slightly relative to arm 12 if the lance meets resistance during its downstroke, and this movement is detected by sensor 80.

Means is provided for monitoring the level of the liquid in the container and controlling the assent of the lance accordingly, as well as preventing over filling of the container. This means comprises a pair of sensing tubes 81, 82 which pass through the side wall of the lance near the top of the lance and extend downwardly within the lance. The opening at the lower end of tube 81 is positioned near the bottom of the lance below the level of the liquid during a normal filling operation. The lower end of tube 82 is spaced somewhat above the lower end of tube 81 and above the level of the liquid during a normal filling operation.

Air is bled into lines 81, 82 from a low pressure source (e.g. 5 psi) through needle valves 83, 84. The pressure in the sensor tubes is monitored by snap relays 86, 87 which can detect a very small change in the pressure in the sensing lines (e.g. 0.1 inch water or 1/280 psi). The fluid output signals from the snap relays are applied to fluid amplifiers 88, 89, and the amplified fluid signals are converted to electrical signals pressure responsive switches 91, 92. The signals from these switches are applied to valve 42 to control the operation of cylinder 19 and, hence, the raising and lowering of the lance.

The components of the system for monitoring the level of the liquid in the container are enclosed in a housing 93 which is mounted on the lower portion of base 11. The output signals from switches 91, 92 are carried by a cable 94.

At the start of a filling operation, the lance descends to its full down position and remains there until the liquid in the container closes off the lower end of sensing line 81. In normal operation, as the lance is withdrawn, the lower end of sensing line 81 continues to be closed by the liquid, while line 82 remains open. Thus, the pressure in line 81 is normally greater than the pressure in line 82. In the event that the lance is withdrawn too quickly, the lower end of line 81 will come out of the liquid, and the pressure in this line will drop. This drop in pressure is sensed by relay 86, and switch 91 is actuated to cause operator control valve 42 to stop the assent.

If the liquid in the container rises too quickly or too high, the lower end of sensing line 82 will become submerged, and the pressure in this line will increase. This increase is sensed by snap relay 87 which actuates switch 92. The signal from switch 92 is applied to control valve 42 to decrease the rate of assent. This signal can also be utilized as a warning that an overflow is about to occur if the tip of the lance is near the top of the container.

The apparatus of FIG. 1 can be used either for subsurface filling or for top filling operations. As illustrated, the apparatus is best suited for subsurface operations. However, it can be converted to top filling operations simply by replacing lance 13 with a shorter lance. Adjustable stops 96 are provided for limiting the travel of the lance for top filling. The stops include a pair of vertically extending rods 97 which are threadedly received in nuts or ferrules affixed to the body of cylinder 19. The rods extend in an upward direction through brackets 101 affixed to arm 12, with stop members 102 at the upper ends of the rods limiting the upward travel of the arm and the lance. In the embodiment illustrated, rods 97 are bolts, and stop members 102 are the heads of the bolts. The amount of travel permitted can be adjusted by advancing or retracting the bolts. When unrestricted movement of the arm and lance is desired, as in a subsurface filling operation, bolts 97 can be removed or otherwise disengaged from brackets 101.

Figure 5:
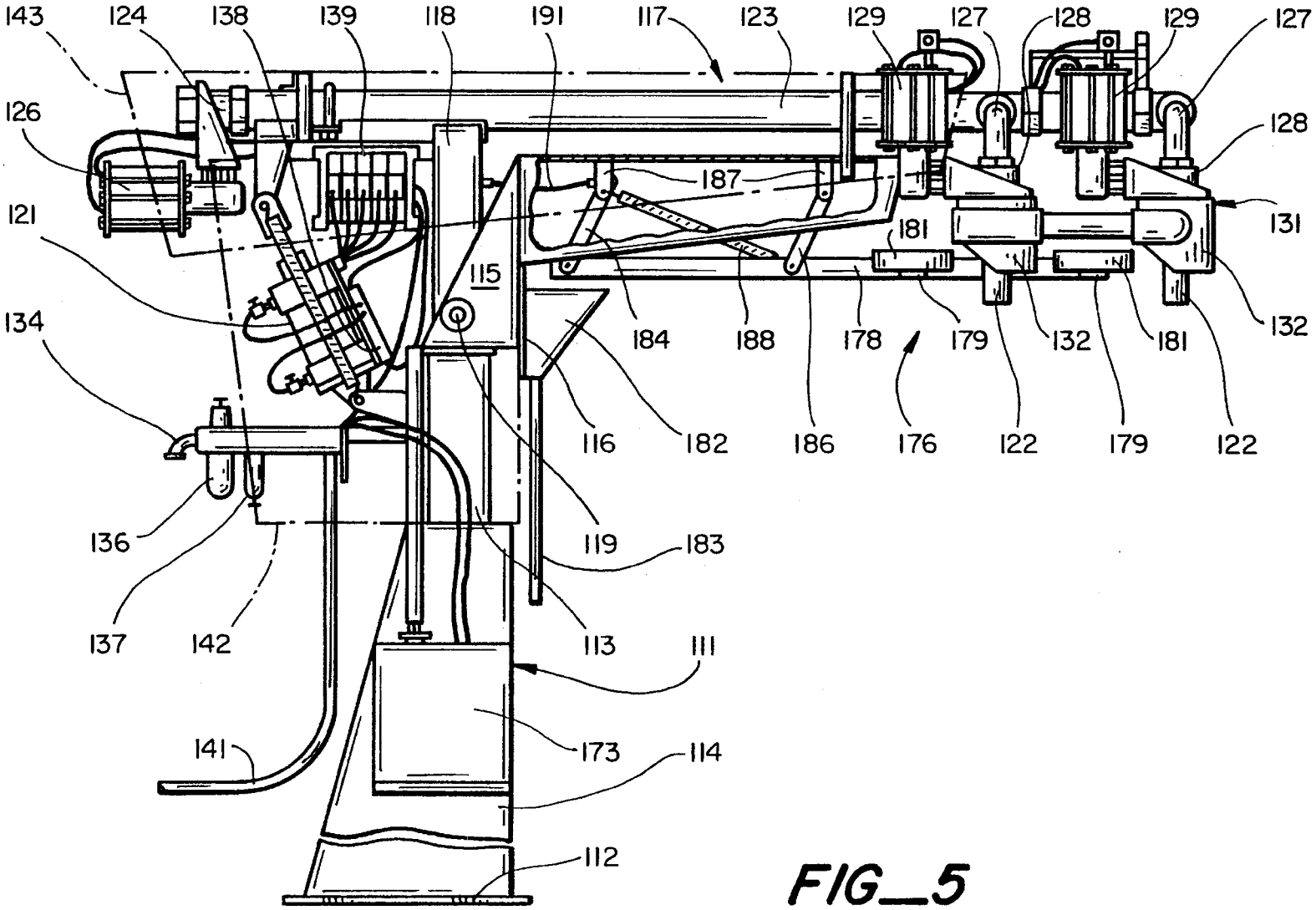
FIG. 5 is a side elevational view, partly broken away, of another embodiment of container filling apparatus according to the invention.

The embodiment illustrated in FIG. 5 has a base 111 which includes a horizontally extending plate 112, an upright post 113, and side plates 114. The post has two telescoping sections which permit the height of the post to be adjusted. A mounting bracket having a pair of side plates 115 and a front plate 116 is affixed to the upper end of the post.

A manifold and arm assembly 117 is pivotally mounted on post 113. The assembly has depending stem 118 which is pivotally mounted between side plates 115 by means of a pivot pin 119. A pneumatic operating cylinder 121 is connected between the base and the rear portion of the manifold and arm assembly for tilting the front portion of the assembly between raised and lowered positions.

The apparatus shown in FIG. 5 is designed for filling four drums or containers on a pallet and it provided with four lances 122 for this purpose. Two of the lances are visible in FIG. 5, and the other two are behind these lances on the other side of the arm. The containers are typically filled one at a time, but they can be filled in a different manner, if desired.

The manifold assembly has a longitudinally extending tube 123 with a pneumatically operated ball valve and actuator 124, 126 at its inlet end. This valve controls the fill rate, i.e. a slow fill or dribble rate or a fast fill or normal rate. Cross tubes 127 extend laterally from both sides of tube 123 toward its outlet end. Lances 122 are connected to the outer ends of the cross tubes, with a separate flow control valve 128 being provided for each of the lances. These valves are operated by pneumatic actuators 129.

An exhaust manifold 131 is provided for removing any fumes which may be emitted during a filling operation. This manifold includes hoods 132 at the upper ends of the lances for collecting the fumes as they emerge from the containers.

Pressurized air (e.g. 90 psi) for operating cylinder 121 and valve actuators 126, 129 is applied to an inlet fitting 134. The air passes through a filter/regulator 136 and a lubricator 137 to electrically operated valves 138, 139 which control the operation of cylinder 121 and the actuators for the valves 124, 128. Valve 138 is mounted on the body of cylinder 121, and valves 139 are mounted on manifold and arm assembly 117. As in the embodiment of FIG. 1, pneumatic signals for controlling the operation of the valves are carried by air lines in a cable 141 from a control panel (not shown), and the valves are connected to the operating cylinder and the actuators by lines fabricated of a suitable material such as plastic.

A cover 142 is mounted on the upper portion of the base, and a top cover 143 is mounted on the manifold and arm assembly.

Figure 6:
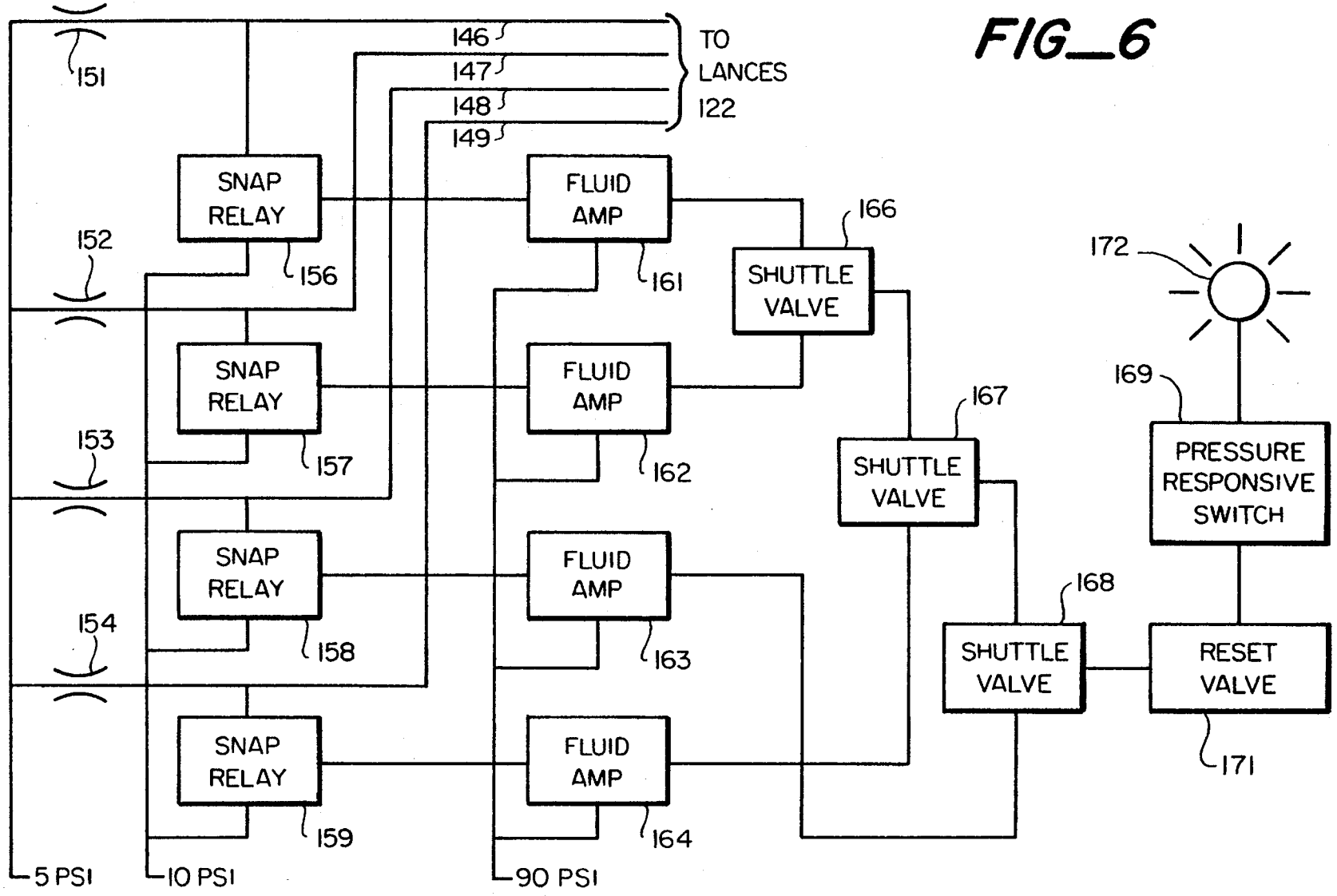
FIG. 6 is a block diagram of a system for preventing overfilling of the containers in the embodiment of FIG. 5.

Means is provided for monitoring the level of the liquid in the containers to prevent over filling of the containers. As illustrated in FIG. 6, this means includes sensing lines 146–149 with discharge openings positioned near the lower ends of the respective lances. If desired, the sensing lines can extend below the ends of the lances in this embodiment. Lower pressure air (e.g. 5 psi) is bled into the sensing lines through needle valves 151–154. The pressure in the respective lines is monitored by snap relays 156–159, and the fluid output signals from the relays are amplified by fluid amplifiers 161–164.

The outputs of the fluid amplifiers are connected to shuttle valves 166–168 which are connected together in a logic network to provide an output signal in the event of a change in pressure in any of the sensing lines. The outputs of fluid amplifiers 161, 162 are connected to the inputs of shuttle valve 166, and the output of this valve and the output of fluid amplifier 164 are connected to the inputs of shuttle valve 167. The output of this valve and the output of fluid amplifier 163 are connected to the inputs of shuttle valve 168.

The fluid output signal from shuttle valve 168 is applied to a pressure responsive switch 169 through a reset valve 171. Switch 169 controls the operation of a warning lamp 172 or another suitable indicator.

The system for monitoring the level of the liquid in the containers is enclosed in a housing 173 which is mounted on the lower portion of base 111.

In operation, sensing lines 146–149 are positioned to be closed by the liquid in the containers if it should rise too high. During normal operation, the ends of the lines are out of the liquid, and the low pressure air passes through the lines freely. If the level of the liquid should rise too high in one of the containers, it will close the line in that container, and the pressure in the line will increase. This increase is detected by the corresponding snap relay, producing an output signal at the corresponding fluid amplifier which is applied to the shuttle valves. This signal passes through the shuttle valves to the pressure responsive switch, causing an overfill indication to be given. If desired, the signal from switch 169 can be utilized to close valves 128 to interrupt the delivery of liquid to the containers.

A drip catcher 176 is provided for catching drippage from lances 122 when the lances are in their raised or retracted position. The drip catcher includes a stationary support arm which extends horizontally from mounting bracket 114, 116 at the upper end of post 113.

The drip catcher includes a central trough 178 which extends in a longitudinal direction below manifold tube 123, with side troughs 179 extending laterally from the central trough. Drip cups 181 are mounted on the outer ends of the side troughs. The side troughs slope downwardly toward the center troughs, and the center trough slopes downwardly toward the rear. A drip collector 182 with a drain line 183 is mounted on the base in position for collecting the liquid from trough 178.

The drip cup and trough assembly is carried by parallel pivot arms 184, 186 for swinging movement between advanced and retracted positions. It is shown in the retracted position in FIG. 5. The upper ends of pivot arms 184, 186 are pivotally connected to mounting brackets 187 which are affixed to support arm 177. The drip cups are urged toward the retracted position by a coil spring 188 which is connected between the upper end of arm 184 and the lower end of arm 186.

A flexible cable 191 is connected between the upper portion of pivot arm 184 and the stem 118 of manifold and arm assembly 117 for moving the drip cups to their advanced position. The cable is somewhat longer than the distance between the pivot arm and the manifold stem when the manifold is in its lowered position so that the cable will not become taut until the bottoms of the lances have risen almost above the drip cups. The cable is connected to pivot arm 184 at a point just above the pin 192 which mounts the arm on bracket 187. Since the distance between the cable connection and pin 192 is much less than the distance between this pin and the pin 193 which connects the arm to the trough, a small movement of the cable produces a much greater movement of the cup and trough assembly.

Figure 7:
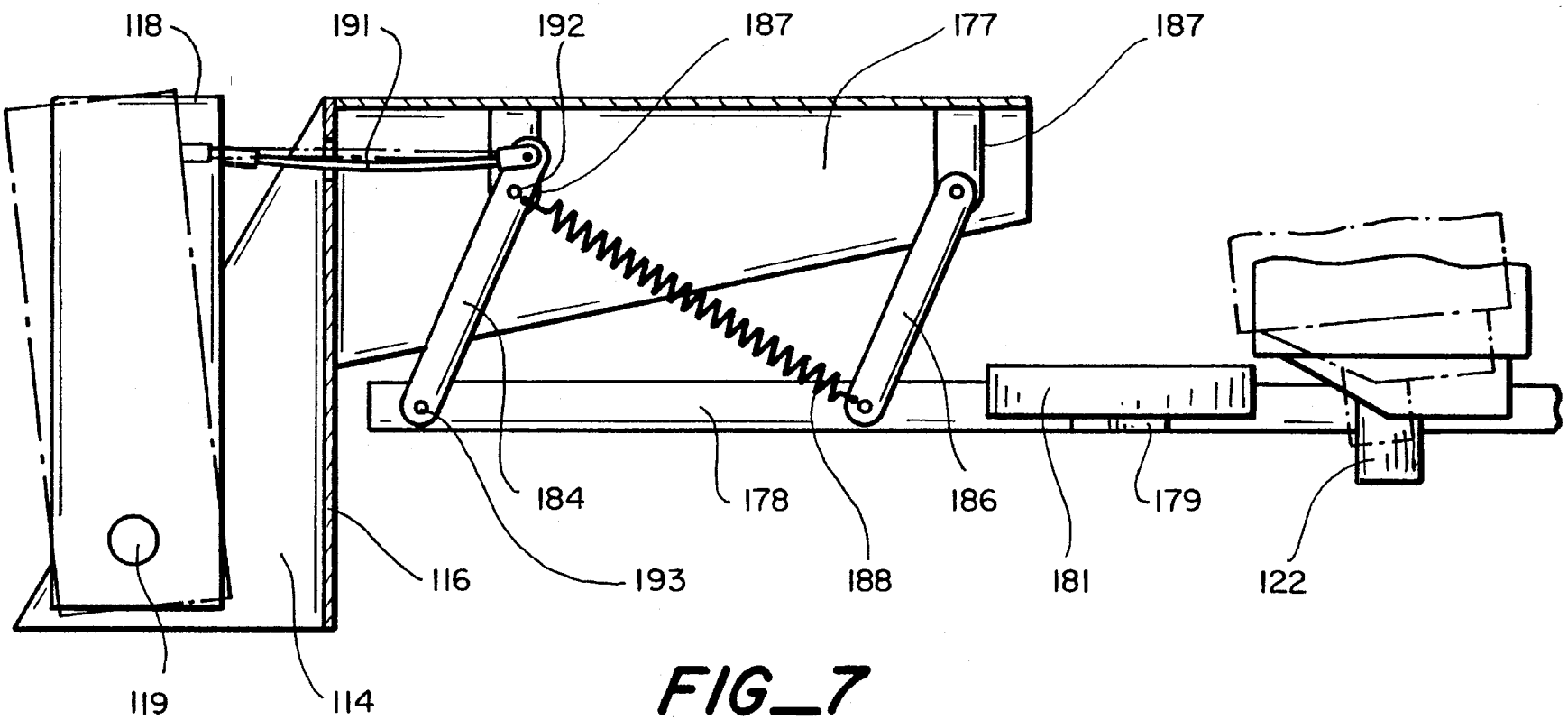
FIGS. 7 and 8 are operational views showing the operation of the drip catcher in the embodiment of FIG. 5.
Figure 8:
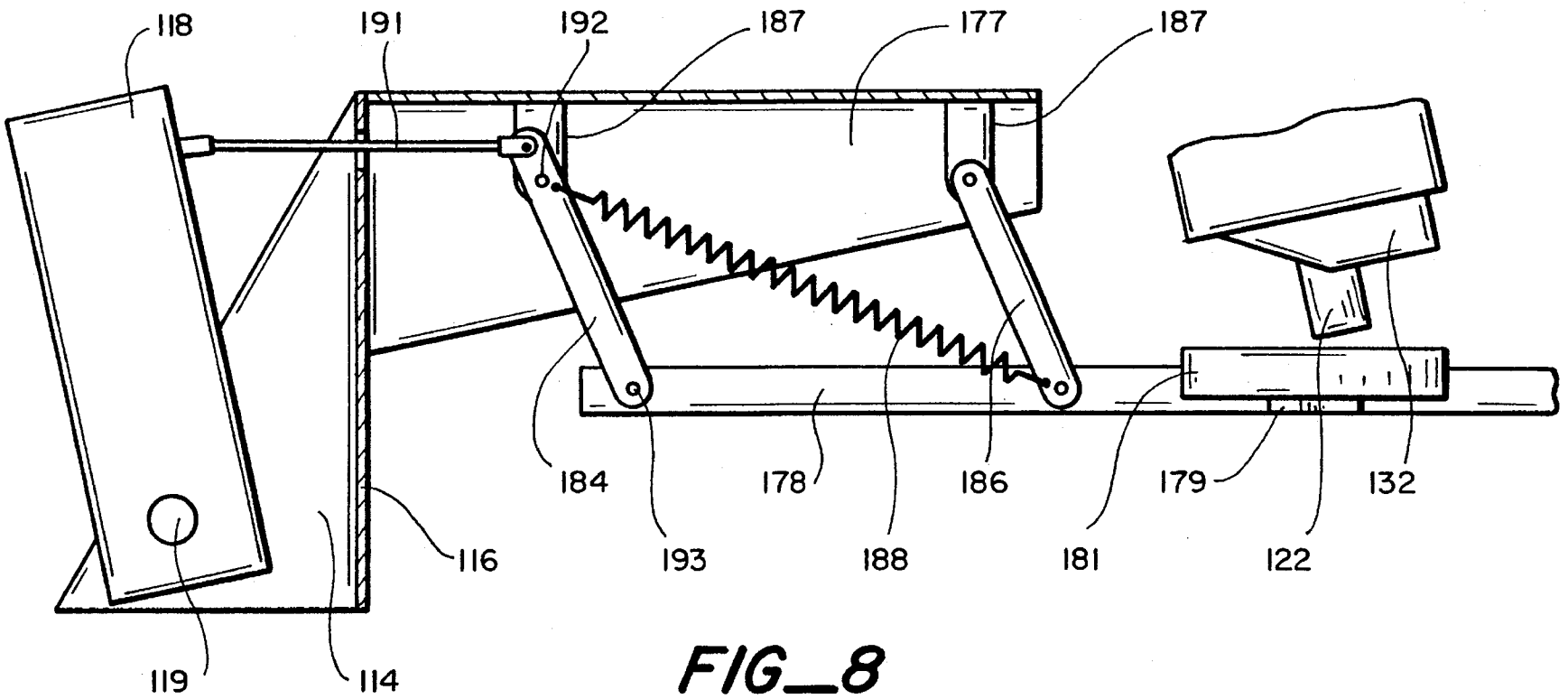

In operation, spring 188 holds the cup and trough assembly in the retracted position until the lances have almost reached the top of their stroke. Prior to this point, cable 191 is relaxed, as illustrated in FIG. 7. As the lances approach the top of their stroke, the cable tightens, as illustrated in phantom lines in FIG. 7. As the manifold and lance assembly continues its upward movement, the taut cable causes pivot arms 184, 186 to pivot in a counter clockwise direction, swinging the drip cup and trough assembly to the advanced position in which drip cups 181 are positioned beneath the lances. Because of the slackened cable and the mechanical advantage provided by pivot arm 184, the drip cup and trough assembly does not begin to move until the lances have almost completed their assent, at which point it moves very rapidly to the advanced position. When the lances are lowered, spring 188 returns the cup and trough assembly to its retracted position.

Figure 9:
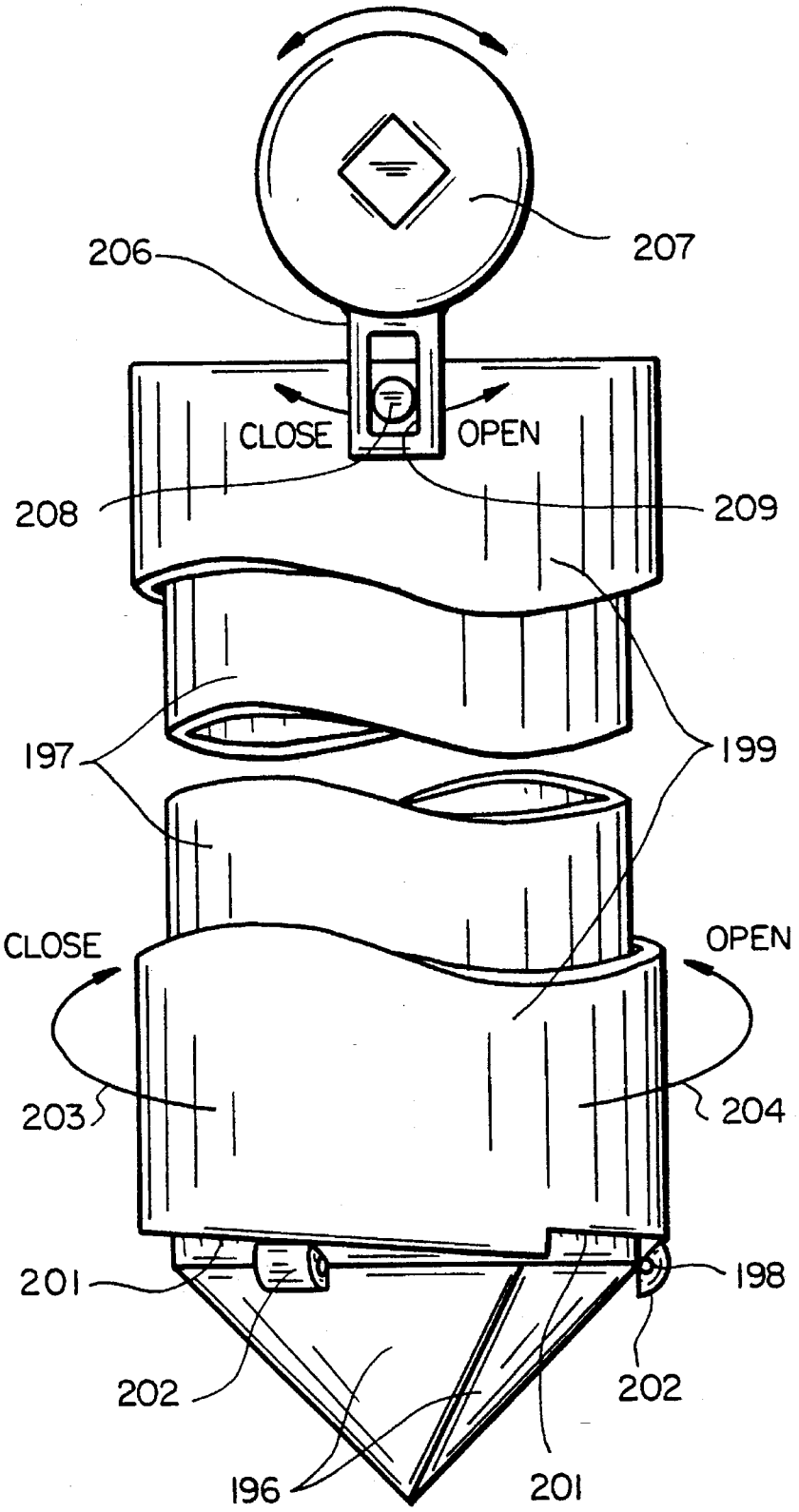
FIG. 9 is a side elevational view, partly broken away, of another embodiment of a lance cap or foot valve for use in container filling apparatus according to the invention.

The end cap or foot valve illustrated in FIG. 9 is similar to the end cap or foot valve in the embodiment of FIG. 1 in that it has a plurality of conically curved sections 196 which are pivotally mounted on the lower end of lance 197 by hinges 198 for movement between open and closed positions. A control sleeve 199 is rotatably mounted on the lance and has a plurality of inclined cam surfaces 201 around its lower end. These surfaces engage arms or flanges 202 which extend upwardly and outwardly from the curved sections. When the sleeve is rotated in the direction indicated by arrow 203, the cam surfaces bear against the arm or levers and press the curved sections together to close the valve. When the sleeve is turned in the direction indicated by arrow 204, the cam surfaces are moved out of contact with the arms or flanges, and the curved sections are free to swing to the open position in response to gravity and the liquid product discharged through the lance.

The end cap or foot valve is moved between its open and closed positions by means of a crank arm 206 which is affixed to the rotary actuator 207 for the ball valve (not shown) which controls the flow of product through the lance. A pin projects radially from the upper portion of sleeve 199 and is received in a slotted opening 209 in the crank arm. As the actuator rotates about a horizontal axis, the crank arm and pin turn the sleeve about a vertical axis to open or close the foot valve.

In the embodiments disclosed, pneumatic cylinders are employed for raising and lower the filling lances. It will be understod, however, that other types of fluid operated actuators (e.g., hydraulic cylinders or combined air and hydraulic cylinders) can be used for this purpose. A hydraulic fluid generally provides a smoother, less abrupt movement than air. Suitable plastic materials for the lines in a hydraulic system include polyvinyl-difluoride and polypropylene. It is apparent from the foregoing that a new and improved apparatus for filling drums and other containers has been provided. While only certain presently preferred embodiments have been described in detail, as will be apparent to those familiar with the art, certain changes and modifications can be made without departing from the scope of the invention as defined by the following claims.

I claim:

1. In apparatus for filling a container with a liquid: a base, an arm mounted on the base for movement between raised and lowered positions, a filling lance carried by the arm for introducing the liquid into the container, valve means for controlling the flow of liquid through the lance, a drip catcher movable between advanced and retracted positions relative to the lance, a flexible cable which is relaxed when the arm is in its lowered position and is drawn taut by movement of the arm toward its raised position, and means connecting the cable to the drip catcher in such manner that the drip catcher is moved to its advanced position upon further movement of the arm toward its raised position.

2. The apparatus of claim 1 wherein the drip catcher is mounted on the base by a pivot arm for swinging movement between the advanced and retracted positions, one end of the cable is connected to the arm which carries the lance, and the other end of the cable is connected to the pivot arm at a point spaced from the drip catcher so that the drip catcher moves a greater distance than the end of the cable connected to the pivot arm.

3. In apparatus for filling a container with a liquid: a base, an arm mounted on the base for movement between raised and lowered positions, a filling lance carried by the arm for introducing the liquid into the container, valve means for controlling the flow of liquid through the lance, a cup having a plurality of conically curved sections hingedly connected to the lower end of the lance for movement between open and closed positions, said sections in the closed position forming a conically shaped closure of no greater diameter than the lance, and means yieldably urging the cap sections toward the closed position but permitting the sections to be moved to the open position by the liquid introduced through the lance.

* * * * *